United States Patent [19]

Berge

[11] 4,234,025

[45] Nov. 18, 1980

[54] GOLF BAG CLUB COVER

[76] Inventor: Richard W. Berge, Rte. 1, Box 410 J, Gainesville, Va. 22065

[21] Appl. No.: 63,526

[22] Filed: Aug. 3, 1979

[51] Int. Cl.[3] ..... A63B 55/00

[52] U.S. Cl. ..... 150/1.5 R; 150/52 G

[58] Field of Search ..... 150/1.5 R, 52 G, 52 R, 150/52 E

[56] References Cited

U.S. PATENT DOCUMENTS

| | | | |
|---|---|---|---|
| 595,685 | 12/1897 | Abraham | 150/52 R UX |
| 2,704,563 | 3/1955 | Henrich | 150/1.5 R |
| 3,620,276 | 11/1971 | Taylor | 150/52 G |
| 3,670,749 | 6/1972 | Buschmann | 150/52 R |
| 3,754,587 | 8/1973 | Rainieri | 150/52 G |

*Primary Examiner*—Donald F. Norton

[57] ABSTRACT

A plastic bonnet or slipcover for the clubs within a golf bag, to protect the same from sudden shower, storm or the like. The bonnet is of clear plastic, generally in the form of a bag without bottom, provided with a "V" notch from top to near bottom as slipped over the golf bag. Easy access to the clubs is thus provided. For protection of the clubs, the top of the bonnet is simply folded down over the heads of the clubs.

5 Claims, 3 Drawing Figures

GOLF BAG CLUB COVER

BACKGROUND OF THE INVENTION

In going around the golf course, it occasionally happens that the golfer must contend with a constant drizzle, as in spring, or is overcome by a sudden shower in summer, or even a sudden hailstorm. Protection of the clubs is imperative. And in many instances the golfer must seek quiet shelter or even throw his jacket over the clubs to protect them and the bag from an accumulation of water.

While many attempts have been made to provide adequate protection for the clubs and the bag, as for example by way of the disclosures of U.S. Pat. No. 2,985,212 to R. H. Dozier, entitled "Golf Bag Cover", U.S. Pat. No. 3,620,276 to Clarence R. Taylor, titled "Golf Bag Slipcover", and particularly U.S. Pat. No. 3,754,587 to Joseph V. Rainieri, entitled "Golf Club Cover", the resultant constructions fall short of the mark; the covers there disclosed are either too bulky, too cumbersome or too costly. In other covers special fastening devices, that is, zippers, snaps and the like, are required, which devices when hastily used are inclined to foul.

SUMMARY OF THE INVENTION

My invention is designed to overcome the deficiencies of prior protective covers for golf bag and clubs and provide a simple, inexpensive, reliable and effective cover or bonnet. The cover is pliable and, when not in use, is folded into a small packet which may be carried in a pocket normally provided on the side of a golf bag or in the pocket of the golfer's jacket.

My cover is in the form of a clear plastic sheath or sack with open top and bottom, which cover may be quickly slipped over the top of a golf bag upon a moment's notice. The cover has a wide "V"-shaped slot in its front as slipped over the bag. Easy access to the clubs is had. And for quick protection of the clubs, the rear portion of the cover is simply flipped forward, covering the heads of the clubs and the open "V"-shaped portion of the cover itself. In proceeding from hole to hole in light shower or drizzle, the clubs are fully protected. With clearing weather the rear potion of the cover is flipped back again, exposing the clubs to ready access.

Upon reaching the ball in play from tee to green, the flap portion of the bonnet is just pushed up a bit or flipped back, and the desired club is withdrawn for use, while the remaining clubs are fully protected from the weather.

An object of the present invention, therefore, is to provide an inexpensive cover or bonnet to protect the clubs within a golf bag, which cover in fair weather may be conveniently carried by the golfer in a pocket and which may be quickly placed over the clubs to protect the same against a sudden shower while the game continues, and which may be effectively removed in part to gain access to the club desired yet protect the remainder.

BRIEF DESCRIPTION OF THE DRAWINGS

In the accompanying drawings, illustrating a preferred embodiment of my invention.

Like reference characters denote like parts throughout several views of the drawings.

DESCRIPTION OF THE PREFERRED EMBODIMENT

Figure 1:
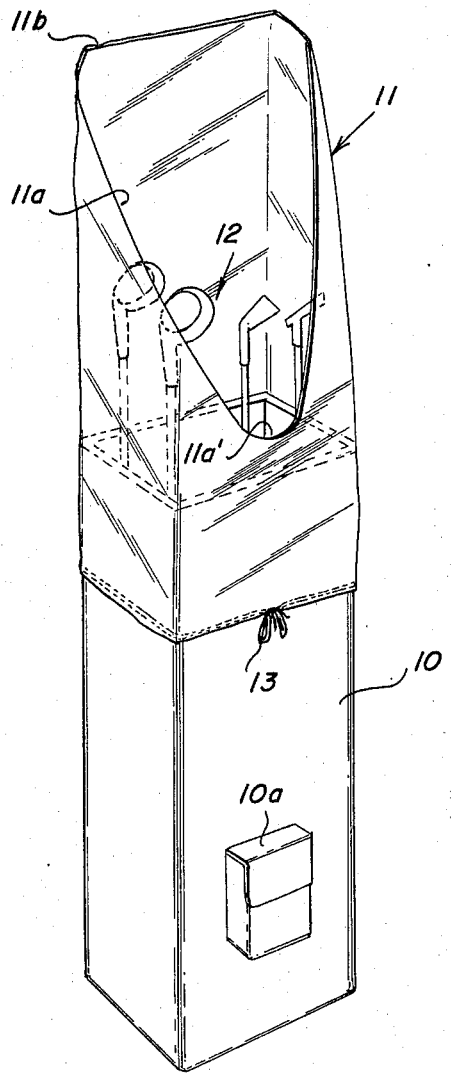
FIG. 1 is a perspective view of a golf bag with my novel cover positioned on the same in open position, making full access to all of the clubs.
Figure 2:
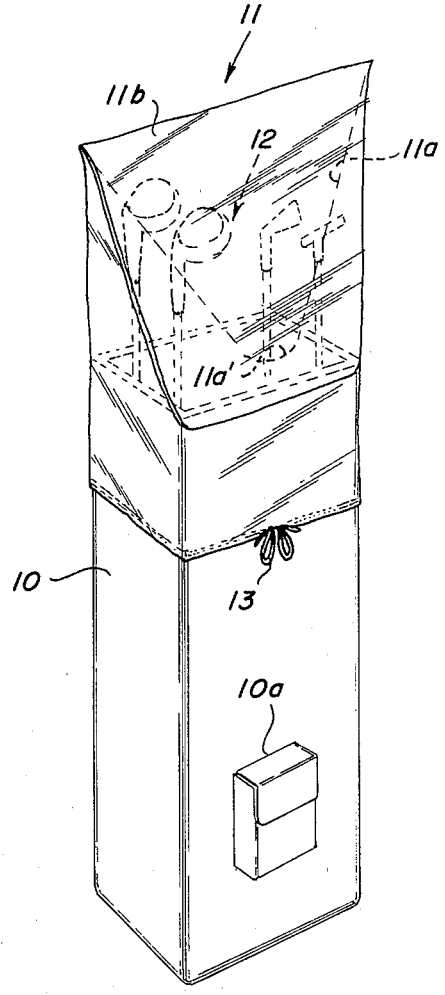
FIG. 2 is a perspective of the bag of FIG. 1 with flap portion flipped down to afford full protection of all clubs.

Referring now more particularly to the practice of my invention, attention is invited to the FIGS. 1 and 2. There I show a golf bag 10, with lower pocket 10*a*, and bonnet or cover 11. The usual golf clubs, notably woods, irons and putter, are shown generally at 12.

In spring drizzle, for example, the bonnet 11 is slipped over the top of the bag 10 as shown in FIG. 1, and secured in position by way of a suitable drawstring 13. Bonnet 11, for economy and visibility, is fashioned of clear plastic, particularly polyethylene of manageable gauge. The bonnet is in the nature of an open-ended sack or sheath of some 18 to 20 inches in length and 35 to 40 inches in circumference. A combination of best results is had with 4-ply polyethylene.

As best seen in FIG. 1 bonnet 11, when in stretched position over the bag and clubs, is provided with a deep notch 11*a*, free of edge defect and incipient crack. For best results the bottom of the notch 11*a*[1] is curved on the order of 1-½ inch radius. The top portion of bonnet 11 flares outwardly to form flap portion 11*b*.

With flap portion up as seen in FIG. 1, the bonnet permits ready access to all clubs. In proceeding around the course, however, flap portion 11*b* is flipped down over the top of the bag as best shown in FIG. 2, fully protecting clubs and the interior of the bag itself from rain, sleet, snow or other falling weather. The clubs are readily visible. And the golfer upon reaching position may quickly lift the bonnet flap just sufficiently to select the desired club. Clubs and bag opening are protected during the play. And flap 11*b* may be quickly flipped up just long enough to return the club. The golfer then may proceed to the next position with clubs fully protected from the inclement weather.

Figure 3:
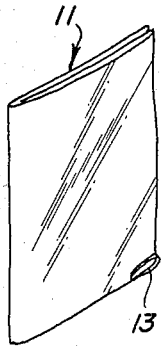
FIG. 3 is a perspective view of the bonnet or cover itself, flattened and folded as for storage in bag pocket or the pocket of the golfer's jacket.

In sunny weather or when otherwise not in use, the bonnet is conveniently folded top to bottom and then edge to edge, and again in the same directions, to form a packet as seen in FIG. 3, for easy accomodation in pocket 10*a* of the golf bag. As desired, further folding of the packet may be done for accomodation in the pocket of the golfer's jacket. Bonnet 11, with drawstring 13, is sufficiently tough and flexible to permit ready handling, as in folding and unfolding, to withstand much actual practical use.

It will thus be seen that I provide in my invention a simple, reliable and inexpensive bonnet or cover for the protection of bag and golf clubs. The bonnet is slipped onto the bag in a matter of seconds; it stays firmly in attached position by way of integral drawstring. The bonnet covers the top of the bag, shields the interior and keeps clubs playably dry. Quick and easy club selection, removal and replacement is had. My bonnet is self-contained and adaptable to virtually all bags.

Inasmuch as many embodiments may be made of my invention and since many changes may be made in the embodiment set out above, it is to be understood that all matter described herein or shown in the accompanying drawings is to be taken as illustrative and not by way of limitation.

I claim:

1. In combination with a golf bag, a cover for clubs contained within said bag comprising a flexible sheath with open top and bottom to slip over the top of said golf bag and contained clubs, which sheath is provided with a large notch in a portion thereof with the top of the notch extending the width of the sheath to provide easy access to the clubs, and which sheath at the top portion thereof may be flipped downward over said notch and clubs.

2. In combination with a golf bag, a cover for clubs contained within said bag comprising a flexible clear plastic sheath with open top and bottom to slip over the top of said golf bag and contained clubs, which sheath is provided with a large "V"-shaped notch portion in the front thereof with the top of said notch portion extending the width of the sheath for lending ready access to the clubs, and which sheath at its upper portion may be flipped forward and downward to cover such notch portion and clubs for the protection of the latter.

3. In combination with a golf bag having a storage pocket therein, a cover for the clubs contained within said bag comprising a polyethylene sheath with open top and bottom portions to slip over the top of the golf bag and contained clubs, which sheath is provided with a large notch in the front thereof with a curved bottom to the notch and the top of said notch extending the width of the sheath for lending ready access to the clubs, and which sheath at its top readily may be flipped downward and forward to cover such notch and clubs for the protection of the latter, and which sheath is of such gauge as to readily lend itself to folding from top to bottom and edge to edge to form a convenient packet for storage in said bag pocket.

4. In combination with a golf bag, a cover for clubs contained within said bag comprising a flexible clear plastic sheath with open top and bottom portion to slip over the top of the golf bag and contained clubs, which sheath is provided with a "V"-shaped notch portion in the front thereof with its top extending the width of the sheath for lending ready access to the clubs, and a back portion which may be flipped forward and downward for the protection of the clubs; and drawstring along the bottom edge of the sheath to assure effective grip of said sheath on said bag.

5. In combination with a golf bag, a cover for clubs contained within said bag comprising a 4-ply polyethylene sheath with open top and bottom to slip over the top of the golf bag and contained clubs, which sheath is provided with a large notch extending from top to near bottom and from side to side at the top of the same for providing easy access to the clubs, and which sheath at its top portion may be flipped downward to cover said notch, said clubs and the top of said bag.

* * * * *